US009783901B2

(12) United States Patent
Minsek

(10) Patent No.: US 9,783,901 B2
(45) Date of Patent: Oct. 10, 2017

(54) ELECTROPLATING OF METALS ON CONDUCTIVE OXIDE SUBSTRATES

(71) Applicant: MacDermid Acumen, Inc., Waterbury, CT (US)

(72) Inventor: David W. Minsek, New Milford, CT (US)

( * ) Notice: Subject to any disclaimer, the term of this patent is extended or adjusted under 35 U.S.C. 154(b) by 507 days.

(21) Appl. No.: 14/204,241

(22) Filed: Mar. 11, 2014

(65) Prior Publication Data

US 2015/0259816 A1 Sep. 17, 2015

(51) Int. Cl.

| | |
|---|---|
| ***C25D 5/10*** | (2006.01) |
| ***C25D 3/12*** | (2006.01) |
| ***C25D 3/22*** | (2006.01) |
| ***C25D 3/38*** | (2006.01) |
| ***C25D 3/56*** | (2006.01) |
| ***C25D 9/08*** | (2006.01) |

(52) U.S. Cl.

CPC ..... *C25D 3/12* (2013.01); *C25D 3/22* (2013.01); *C25D 3/38* (2013.01); *C25D 3/565* (2013.01); *C25D 5/10* (2013.01); *C25D 9/08* (2013.01)

(58) Field of Classification Search

CPC ..... C25D 5/10; C23C 28/021; C23C 28/023; C23C 28/025; C23C 28/30; C23C 28/32; C23C 28/321; C23C 28/3225; C23C 28/345

USPC ..... 205/177, 183, 191, 170, 176, 182

See application file for complete search history.

(56) References Cited

U.S. PATENT DOCUMENTS

| | | | | |
|---|---|---|---|---|
| 4,462,883 | A * | 7/1984 | Hart | C03C 17/36 204/192.13 |
| 4,586,988 | A | 5/1986 | Nath et al. | |
| 4,824,693 | A | 4/1989 | Schlipf et al. | |
| 4,898,652 | A | 2/1990 | Bammel et al. | |
| 5,200,057 | A | 4/1993 | Canaris | |
| 5,384,154 | A | 1/1995 | DeBakker et al. | |
| 6,664,633 | B1 | 12/2003 | Zhu | |
| 6,676,823 | B1 | 1/2004 | Bokisa | |
| 6,827,834 | B2 | 12/2004 | Stewart et al. | |
| 7,827,930 | B2 | 11/2010 | Lubomirsky et al. | |
| 7,960,644 | B2 | 6/2011 | Sinha | |
| 8,283,557 | B2 | 10/2012 | Yu et al. | |
| 2002/0192486 | A1* | 12/2002 | Chen | C25D 1/04 428/607 |
| 2004/0217009 | A1 | 11/2004 | Mikkola et al. | |
| 2006/0043895 | A1 | 3/2006 | Choi | |
| 2006/0283715 | A1* | 12/2006 | Diaddario, Jr. | C25D 3/565 205/245 |
| 2008/0236441 | A1 | 10/2008 | Nobe | |
| 2009/0084438 | A1* | 4/2009 | den Boer | H01L 31/02168 136/256 |
| 2010/0065101 | A1 | 3/2010 | Zaban et al. | |
| 2010/0078055 | A1* | 4/2010 | Vidu | B82Y 10/00 136/244 |
| 2010/0200408 | A1 | 8/2010 | Liu et al. | |
| 2011/0277825 | A1 | 11/2011 | Fu et al. | |
| 2012/0097244 | A1 | 4/2012 | Adachi et al. | |
| 2012/0181573 | A1 | 7/2012 | Zaban et al. | |
| 2012/0305060 | A1 | 12/2012 | Fu et al. | |
| 2014/0048013 | A1* | 2/2014 | Ding | C30B 23/025 117/58 |

FOREIGN PATENT DOCUMENTS

| | | | | |
|---|---|---|---|---|
| CN | 102214734 A | * | 10/2011 | H01L 31/18 |
| EP | 0 492 790 | | 7/1992 | |
| EP | 0 518 422 | | 9/1995 | |
| KR | 2013035331 A | * | 4/2013 | H01L 31/072 |
| KR | 20130035331 A | * | 4/2013 | H01L 31/072 |
| WO | 2010/110870 | | 9/2010 | |

OTHER PUBLICATIONS

Abd El Rehim et al., "Electroplating of Cobalt from Aqueous Citrate Baths," Journal of Chemical Technology & Biotechnology (no month, 1998), vol. 73, No. 4, pp. 369-376. Abstract Only.*

Wellings et al., "Comparison of Electrodeposited and Sputtered Intrinsic and Aluminium-Doped Zinc Oxide Thin Films," Semicond. Sci. Technol. (no month, 2008), vol. 23, pp. 1-7.*

Durairajan et al., "Electrochemical Characterization of Cobalt-Encapsulated Nickel as Cathodes for MCFC," Journal of Power Sources (no month, 2002), vol. 104, pp. 157-168.*

Abd El Rehim et al., "Electroplating of Cobalt from Aqueous Citrate Baths," Journal of Chemical Technology & Biotechnology (no month, 1998), vol. 73, No. 4, pp. 369-376.*

Wikipedia: "Electroplating," pp. 1-7. Printed on Apr. 13, 2017.*

* cited by examiner

*Primary Examiner* — Edna Wong

(74) *Attorney, Agent, or Firm* — Carmody Torrance Sandak & Hennessey LLP

(57) ABSTRACT

A method of electroplating metal onto a transparent conductive oxide layer is described. The method comprises the steps of a) electroplating a zinc or zinc oxide seed layer directly onto the transparent conductive oxide layer and thereafter, b) electroplating one or more additional metal layers over the zinc layer. The one or more additional metal layers may include a cobalt strike layer electroplated over the zinc or zinc oxide seed layer and another metal layer such as copper, electroplated over the cobalt strike layer.

20 Claims, No Drawings

ELECTROPLATING OF METALS ON CONDUCTIVE OXIDE SUBSTRATES

FIELD OF THE INVENTION

The present invention relates generally to a method and compositions for electroplating metal contacts directly onto transparent conductive oxides.

BACKGROUND OF THE INVENTION

Transparent conductive oxides (TCO) are metal (or mixtures of metals) oxides that possess the usually mutually exclusive properties of high transparency and electrical conductivity. TCO materials are transparent to electromagnetic radiation in the visible region of the spectrum due to a high optical bandgap. At the same time, the electrical conductivity is good due to high electron mobility. TCO materials include, for example, tin-doped indium oxide (ITO), aluminum-doped zinc oxide (AZO), boron-doped zinc oxide (BZO) and fluorine-doped tin oxide (FTO), by way of example and not limitation.

Intrinsic to optoelectronic devices is the interaction of light with an electrically active component. Such devices include photovoltaic (PV) cells, photodiodes, flat panel displays, touch screens, light emitting diodes, phototransistors, semiconductor lasers, and the like. Typically, such devices must contain at least one electrically conductive electrode that is transparent to light. A TCO coating over a transparent, non-conductive, glass substrate may provide an essential coating material for such applications. TCO coatings on transparent substrates may also be used for transparent heating elements, antistatic coatings, or electromagnetic shielding.

Currently, the majority of photovoltaic solar cells manufactured are based on a substrate of crystalline silicon, with layers of p-doped and n-doped silicon forming a p-n junction such that absorption of ultraviolet, visible and infrared light results in a voltage across the cell. At least one side of a cell must be transparent to light in order to function, and typically a thin coating of a non-conductive oxide or nitride forms the outermost layer of a cell. Properly designed, this layer both passivates defects on the surface of the silicon and reduces reflection of light that would cause loss of power generation. TCO coatings may be used as the front and/or back sides of photovoltaic solar cells. A TCO coating offers the advantage that the entire front and/or back surfaces of the cell are electrically conductive, allowing for efficient collection of electric current, while still functioning as an anti-reflective coating. One such solar photovoltaic cell that uses such a TCO coating is what is known as a silicon heterojunction (SHJ) cell, in which the base substrate of the cell comprises a crystalline silicon wafer, with an amorphous, intrinsic (i-type) silicon thin film layer deposited on the crystalline silicon, and doped amorphous layers of silicon deposited over the intrinsic layer providing a p-n junction. This cell technology is described, for example, in U.S. Pat. No. 8,283,557 to Yu et al., U.S. Pat. No. 7,960,644 to Sinha, U.S. Pat. Pub. No. 2012/0305060 to Fu et al., and U.S. Pat. Pub. No. 2012/0097244 to Adachi et al., the subject matter of each of which is herein incorporated by reference in its entirety.

In order for electrical current to be collected for power generation, electrical contact to both sides of the cell to an external circuit must be made. The contacts typically comprise a metallic pattern in ohmic contact with the device.

The ideal contacting pattern will have:

(1) high conductivity in order to minimize resistive losses;

(2) low contact resistance with the substrate;

(3) low surface area in order to minimize shading losses; and (4) high adhesion to the substrate to ensure mechanical stability.

In order to obtain maximum efficiency, the entire surface of a photovoltaic cell would ideally be covered by highly conductive material. However, pure metals possess very high reflectivity and absorption of light, rendering them unsuitable as blanket coatings. While TCO coatings offer both transparency and electrical conductivity, the bulk resistivity of TCO (approximately 100 μΩ-cm for ITO) is still much greater than pure metals, leading to high resistive losses and efficiency loss due to the sheet resistance of a thin TCO film. In addition, these losses become more severe as the area size of the device becomes larger.

In order to reduce resistive losses and improve current collection, a metallic grid comprising fingers and busbars may be fixed in contact with the TCO such that ohmic contact is made between the grid and the TCO. This grid results in partial shading of light from the device, resulting in loss of power. Thus, the area of the grid is generally kept to a minimum.

Silver paste is a common conductor material for collection of electrical current from the cell. The paste can be screen printed in the desired grid pattern of fingers and busbars, dried, and sintered at high temperature. Although this offers the advantages of high throughput and low contact resistance, it also suffers the disadvantage of higher bulk resistivity as compared with pure metals. Glass frit material can be added to improve mechanical properties (including adhesion), but this results in decreased conductivity. A dense, solid metallic conductor grid material would therefore be advantageous. However, attachment of metals to TCO coatings is problematic, because metals typically form contacts to TCOs that exhibit very low adhesion.

U.S. Pat. No. 4,586,988 to Nath et al., the subject matter of which is herein incorporated by reference in its entirety, describes a method and compositions for the deposition of nickel, copper, and other metals onto ITO substrates. However, non-adherent layers are obtained when these metals are plated onto ITO substrates.

U.S. Pat. No. 4,824,693 to Schlipf et al., the subject matter of which is herein incorporated by reference in its entirety, describes a method of depositing a metallic conductor on ITO on glass substrates by electroless metallization. The ITO is activated by treatment with a solution of colloidal palladium followed by electroless plating of nickel. However, such a method suffers from several disadvantages. Treatment with colloidal palladium tends to non-selectively activate both conductive and non-conductive substrates, causing unwanted metal deposition to occur in some areas. In addition, metal layers deposited by electroless plating generally have poor adhesion.

U.S. Pat. No. 5,384,154 to De Bakker et al., the subject matter of which is herein incorporated by reference in its entirety, also describes a method for deposition of metals onto ITO on glass substrates, where the ITO is activated by treatment with a colloidal palladium solution followed by electroless nickel plating. This method also produces metal layers generally having poor adhesion.

U.S. Pat. Pub. No. 2010/0065101 and U.S. Pat. Pub. No. 2012/0181573 both to Zaban et al., the subject matter of each of which is herein incorporated by reference in its entirety, describe methods for electroplating metals onto TCO coatings, wherein the metal electroplating is preceded by an "electrolysis reduction" step in which cathodic current is supplied to the substrate in the absence of platable metal ions, causing partial reduction of metal cations in the TCO to metal, and subsequently electroplating nickel, cobalt or copper, which was reported to improve adhesion. However, it was found that such a step may easily damage the TCO, causing degradation of electrical and mechanical properties.

Lukyanov et al., Proc. 27$^{th}$ European Photovoltaic Solar Energy Conference and Exhibition, 1680 (2012), reported that direct electroplating of copper onto ITO-coated photovoltaic cells resulted in poor adhesion if the copper layer had a thickness of greater than 500 nm.

Thus, there remains a need in the art for an improved method of electroplating metals onto TCO substrates that overcomes the deficiencies of the prior art.

SUMMARY OF THE INVENTION

It is an object of the present invention to provide an improved method of electroplating metals onto transparent conductive oxide surfaces.

It is another object of the present invention to provide an improved method of electroplating metals onto transparent conductive oxide surfaces that provides good adhesion of the metal to the transparent conductive oxide surface.

It is another object of the present invention to provide an improved method of electroplating metals onto transparent conductive oxide surfaces to provide good electrical conductivity and corrosion resistance.

It is still another object of the present invention to provide an improved method of electroplating metals onto transparent conductive oxide surfaces that uses a seed layer to deposit zinc directly onto the transparent conductive oxide surface.

To that end, in one embodiment, the present invention relates generally to a method of electroplating metal onto a transparent conductive oxide layer, the method comprising the steps of:

a) electroplating a zinc, zinc alloy or zinc oxide seed layer directly onto the transparent conductive oxide layer; and thereafter
b) electroplating one or more additional metal layers over the zinc containing seed layer.

DETAILED DESCRIPTION OF THE PREFERRED EMBODIMENTS

One of the essential features of the present invention is the use of a seed layer on the TCO layer comprising zinc, wherein the zinc seed layer is deposited directly on the TCO layer by electroplating from a bath containing zinc(II) ions.

Thus, in one embodiment, the present invention relates generally to a method for electroplating metals onto transparent conductive oxide (TCO) layers or surfaces. The TCO may be selected from tin-doped indium oxide (ITO), aluminum-doped zinc oxide (AZO), boron-doped zinc oxide (BZO) and fluorine-doped tin oxide (FTO), among others. In addition, the TCO layer may, for example be applied to a glass or silicon substrate.

The method generally comprises the steps of:

a) electroplating a zinc, zinc alloy, or zinc oxide seed layer directly onto the transparent conductive oxide layer; and thereafter
b) electroplating one or more additional metal layers over the zinc containing seed layer.

It is believed that because zinc is a relatively reactive metal, i.e., with a highly negative equilibrium redox potential, metallic Zn(0) in contact with a TCO may be oxidized to Zn(II) at or near the metal/TCO interface, forming zinc oxide and thereby providing a strong adhesive bond to the TCO. In addition to zinc, zinc alloys, and zinc oxide, Fe, Cr, and oxides of the foregoing will also accomplish the same result. However Zn is preferred.

An essential aspect of the invention is a first step of electroplating a zinc or zinc alloy seed layer directly onto the conductive oxide. Subsequently, additional metals can be electroplated over the zinc layer in order to increase electrical conductivity or corrosion resistance. In this way, thick (e.g., >5 micron) layers of metal can be attached to the transparent conductive oxide layer with good adhesion.

Zinc electroplating can be accomplished using plating baths based on cyanide zinc, alkaline zinc, and acid zinc. The use of cyanide is not preferred due to both the highly alkaline nature of the bath and the toxicity of the cyanide. Likewise, alkaline zinc is not preferred because a highly alkaline bath may cause corrosion of oxide substrates, including TCOs. Additionally, highly alkaline baths may not be compatible with polymeric resist materials that may be used to form patterns on the substrate. Based thereon, mildly acidic (pH≈5-6) zinc plating baths are generally preferred.

Any soluble zinc salt may be used. However, it is preferable that the anionic counter-ion is not a strong complexing agent for zinc(II) cations, which would tend to lower the redox potential, thus making the $Zn^{2+}$ harder to reduce to Zn(0) metal. Preferred zinc salts include zinc sulfate, zinc methanesulfonate, zinc nitrate and zinc halides. The Zn salt may be present at a concentration ranging from about 0.5 to about 10.0 grams/liter, more preferably about 1 to about 7 grams/liter in order to maintain good plating uniformity across the entire surface of the plated substrate.

The pH should be maintained in a range of about 5.0 to about 6.0. If the pH is greater than 6.0, the zinc hydrate salts will precipitate. On the other hand, if the pH is less than 5.0, corrosion of the plated zinc layer may occur. Thus, the plating bath preferably contains a buffer, such as boric acid. It is desirable that the buffer does not contain a strongly complexing ion to zinc cations that would make reduction more difficult. The concentration of boric acid in the solution, if used is generally in the range of about 10 to about 50 grams/liter.

Optionally, a secondary metal ion may be added to improve the properties of the zinc deposit. The properties may be improved by modification of the microscopic structure of the zinc coating, by inclusion of a small amount of alloying metal, thereby improving the corrosion resistance of the zinc coating, or both. As a secondary metal ion, cobalt(II) and nickel(II) are advantageous. Any soluble cobalt or nickel salt may be used. However, it is preferable that the anionic counter ion is not a strong metal complexing agent. Examples of suitable materials include cobalt sulfate and nickel sulfate, by way of example and not limitation. If used, the concentration of the cobalt or nickel salt in the solution is in the range of about 2 to about 8 grams/liter, more preferably about 3 to about 6 grams/liter.

Finally, other additives may optionally be included in the electroplating composition to improve the properties of the plated zinc coating. The additives can improve the thickness distribution (levelers), the reflectivity of the plated film (brighteners), its grain size (grain refiners), stress (stress reducers), adhesion and wetting of the part by the plating solution (wetting agents) and other process and film properties and examples. A preferred additive is a polyalkylene oxide block copolymer, such as UCON™ 75-H-1400 (available from Dow Chemical), which comprises a co-polymer of 75% ethylene glycol and 25% propylene glycol with a number average molecular weight of 2470 grams/mole. If used, the concentration of the additive is generally in the range of about 100 mg/liter to about 500 mg/liter.

Electroplating of zinc for this invention is conducted using an inert anode, which may, for example be a mixed metal anode or may alternatively be a platinum or iridium oxide coated titanium anode. The temperature of the plating bath is generally maintained at between about 20 and about 40° C., more preferably between about 25 and about 30° C. while the substrate is immersed in or otherwise contacted with the plating bath. Plating is conducted for about 1 to about 5 minutes, more preferably about 2 to about 4 minutes. The current in the bath is typically maintained at about 0.2 to 2.0 amps per square decimeter (asd), more preferably about 0.5 to 1.0 asd.

Following the electrodeposition of the zinc seed layer, additional metals may be electroplated over the zinc in order to build up thickness and increase electrical conductivity. Copper is often preferred for this purpose due to its high conductivity, low cost and ease of electroplating. However, there may be difficulties in electroplating copper directly onto zinc due a galvanic exchange that occurs on contact between zinc metal and aqueous solutions containing $Cu^{2+}$ since the redox potential of copper is much higher than that of zinc, which may cause rapid corrosion of the zinc layer and deposition of loose, non-coherent copper, typically resulting in poor coverage and adhesion.

To address this problem, a "strike" layer may be used, which comprises electroplating a layer using a solution of a strongly complexed metal, while making the redox potential sufficiently low to prevent galvanic exchange. One such strike method for zinc comprises a nickel glycolate plating bath. However, the inventors of the present invention have found that it is preferable to use a strike bath of Co(II) to plate an intermediate metal layer on the zinc seed layer with minimal corrosion of the zinc. One suitable cobalt salt is cobalt sulfate. The cobalt salt is typically present in the strike bath at a concentration in the range of about 2 to about 8 grams/liter. It is also essential that a complexing anion may be present, which serves to lower the redox potential of Co(II) making galvanic exchange unfavorable. Citrate is suitable for this purpose although other similar complexing anions are also suitable. The citrate may be present in the strike bath at a concentration of about 20 to about 40 grams/liter. The strike bath typically is maintained at a pH of about 8.0 and a hydroxide such as potassium hydroxide is suitable for this purpose. In addition, the cobalt strike composition may also include a buffer such as boric acid. The concentration of the boric acid is typically in the range of about 40 to about 50 grams/liter.

Electroplating with the cobalt strike bath is typically conducted using an inert anode, which may be a mixed metal anode or a platinum or iridium oxide coated titanium anode. The temperature of the plating bath is generally maintained at between about 20 and about 40° C., more preferably between about 25 and about 30° C. while the substrate is immersed in or otherwise contacted with the plating bath. Plating is conducted for about 1 to about 5 minutes, more preferably about 2 to about 4 minutes. The current in the bath is typically maintained at about 0.2 to 2.0 asd, more preferably about 1.0 to 2.0 asd.

Following the strike electroplating, any metal may be electroplated on the plated 110 layer. Copper is preferred due to high conductivity, relatively low cost, and ease of plating, although other metals can also be used and would be well known to those skilled in the art.

Copper may be plated from a wide variety of plating baths, and there are three general types of copper plating processes that are commonly used. The first type of process is an alkaline bath that may contain cyanide. The second type of process uses an acid bath and contains sulfate or fluoroborate as a complexor. The third type of process is a mildly alkaline pyrophosphate complexed bath. Any of these three types of copper plating processes may be used in the practice of the invention. However, in a preferred embodiment, a pyrophosphate copper plating bath is used.

Pyrophosphate copper baths are mildly alkaline, making them less corrosive than acid baths and are essentially non-toxic. Pyrophosphate copper baths are generally described, for example in U.S. Pat. No. 6,827,834 to Stewart et al. and U.S. Pat. No. 6,664,633 to Zhu, the subject matter of each of which is herein incorporated by reference in its entirety. Copper pyrophosphate dissolved in potassium pyrophosphate forms a stable complex ion from which copper plates. Potassium is typically used instead of sodium because it is more soluble and has a higher electrical conductivity. The pyrophosphate copper plating bath also typically includes nitrate to increase the maximum allowable current density and reduce cathode polarization. Ammonium ions may be added to the bath to produce more uniform deposits and to improve anode corrosion. Finally, an oxalate may be added to the bath as a buffer.

In a preferred embodiment, the pyrophosphate copper bath comprises about 20 to about 30 g/L of a copper salt, such as copper pyrophosphate and about 200 g/L to about 300 g/L of potassium pyrophosphate. The bath may also comprise about 5 to about 15 g/L of a nitrate such as ammonium nitrate as well as 20 to about 40 g/L of an oxalate such as ammonium oxalate hydrate. Ammonium hydroxide may be used to maintain the pH of the copper bath at between about 8.0 and about 9.0.

Electroplating is typically conducted using a copper anode. The temperature of the plating bath is generally maintained at between about 30 and about 60° C., more preferably between about 40 and about 50° C. while the substrate is immersed in or otherwise contacted with the plating bath. Plating is conducted for about 2 to about 15 minutes, more preferably about 5 to about 10 minutes. The current in the bath is typically maintained at about 1.0 to 8.0 asd, more preferably about 2.0 to 3.0 asd.

The resulting copper deposit typically has a thickness of at least about 4 microns, more preferably a thickness of between about 4 and about 20 microns.

The invention will now be described with reference to the following non-limiting examples:

EXAMPLE 1

A glass slide (Delta Technologies, Loveland, Colo.) with ITO coating on one side, with a sheet resistance of 8-12 ohms/square was electroplated using a plating bath as follows:

1.5 g/L $Zn^{2+}$ (as zinc sulfate)
3.0 g/L $Co^{2+}$ (as cobalt sulfate)
16 g/L boric acid
300 mg/L UCON 75-H-1400 (Dow Chemical Co.)
pH=5.2

The width of the slide was 7 mm and the plated area was 1.4 $cm^2$ in area. The substrate was plated by contacting the negative terminal of a rectifier power supply to the ITO-coated substrate, and the positive was attached to a zinc anode also immersed in the solution. A current of 4 mA (0.3 ASD) was supplied to the circuit for 3 minutes, resulting in a shiny, metallic, adherent coating on the ITO surface. EDAX analysis of the plated film showed the composition was about 2.4% Co and 97.6% Zn.

EXAMPLE 2

A glass slide of the same structure as Example 1, with dimensions of 0.7 cm×4.5 cm, was electroplated in 3 steps as described below:

(1) Zinc plating. A substrate with ITO-coated area of 3.15 $cm^2$ was plated with zinc in the plating bath give below:
1.5 g/L $Zn^{2+}$ (as zinc sulfate)
5.0 g/L $Co^{2+}$ (as cobalt sulfate)
45 g/L boric acid
104 mg/L UCON 75-H-1400 (Dow Chemical Co.)
pH=5.2

The substrate and a mixed metal oxide inert anode were immersed in the plating bath at ambient temperature and a current of 15 mA (0.5 asd) was supplied to the circuit for 3 minutes. The sample was then rinsed with de-ionized water and dried, resulting in a shiny metallic, adherent coating over the ITO.

(2) The sample was then plated with cobalt using the plating bath given below.
3.2 g/L $Co^{2+}$ (as cobalt sulfate)
32.2 g/L trisodium citrate dihydrate
45 g/L boric acid
Potassium hydroxide to pH=8.0

The substrate and a mixed metal oxide inert anode were immersed in the plating bath at ambient temperature and a current of 20 mA was supplied to the circuit for 3 minutes. The sample was then rinsed with deionized water and dried, resulting in a shiny metallic, adherent coating over the ITO.

(3) Copper plating. The sample was then plated with copper using the plating bath given below:
25.0 g/L copper (as copper pyrophosphate)
220 g/L potassium pyrophosphate
9.7 g/L ammonium nitrate
32.3 g/L ammonium oxalate hydrate
Ammonium hydroxide to pH=8.5

The substrate and a copper anode were immersed in the plating bath at a temperature of 50° C. and a current of 65 mA was supplied to the circuit for 10 minutes, resulting in a copper layer over the ITO of about 4.5 microns thickness.

The peel strength of the combined plated metal layer was measured by attaching a strip of copper foil using epoxy resin and measuring the force required to peel using a peel strength tester (XYZTEC Condor 70). A force of about 3.4N was measured.

EXAMPLE 3

A glass substrate coated with fluorine tin oxide (FTO) on one side (Aldrich Chemical Co.) having a sheet resistance of 7 ohm/square and dimensions of 0.9 cm×7.0 cm was plated as follows:

(1) Zinc plating. The substrate was plated with zinc in the following plating bath:
1.5 g/L $Zn^{2+}$ (as zinc sulfate)
5.0 g/L $Co^{2+}$ (as cobalt sulfate)
45 g/L boric acid
104 mg/L UCON 75-H-1400 (Dow Chemical Co.)
pH=5.2

The substrate and a metal oxide mesh inert anode were immersed in the plating bath at ambient temperature and a current of 45 mA was supplied to the circuit for 4 minutes, resulting in a shiny metallic, adherent coating on the FTO surface.

(2) Cobalt plating. The sample was then plated with cobalt using the plating bath given below:
3.2 g/L $Co^{2+}$ (as cobalt sulfate)
32.2 g/L trisodium citrate dihydrate
45 g/L boric acid
Potassium hydroxide to pH=8.0

The substrate and a metal oxide mesh inert anode were immersed in the plating bath at ambient temperature and a current of 65 mA was supplied to the circuit for 3 minutes, resulting in a shiny metallic, adherent coating on the FTO surface.

(3) Copper plating. The sample was then plated with copper using the planting bath given below:
25.0 g/L copper (as copper pyrophosphate)
220 g/L potassium pyrophosphate
9.7 g/L ammonium nitrate
32.3 g/L ammonium oxalate hydrate
Ammonium hydroxide to pH=8.5

The substrate and a copper anode were immersed in the plating bath at a temperature of 50° C. and a current of 125 mA was supplied to the circuit for 10 minutes, resulting in a strongly adherent copper layer with about 5.0 microns thickness.

EXAMPLE 4

A silicon substrate coated with indium tin oxide on one side and having a sheet resistance of 30 ohm/square and dimensions of 0.2 cm×4.5 cm was plated as follows:

(1) Zinc plating. The substrate was plated with zinc in the plating bath set forth below:
7.0 g/L $Zn^{2+}$ (as zinc sulfate)
3.0 g/L $Co^{2+}$ (as cobalt sulfate)
30 g/L boric acid
276 mg/L UCON 75-H-1400 (Dow Chemical Co.)
pH=5.2

The substrate and a metal oxide mesh inert anode were immersed in the plating bath at ambient temperature and a current of 10 mA was supplied to the circuit for 3 minutes, resulting in a white, metallic, adherent coating on the ITO surface.

(2) Cobalt plating. The sample was then plated with cobalt in the plating bath set forth below:
3.2 g/L $Co^{2+}$ (as cobalt sulfate)
32.2 g/L trisodium citrate dihydrate
45 g/L boric acid
Potassium hydroxide to pH=8.0

The substrate and a metal oxide mesh inert anode were immersed in the plating bath at ambient temperature and a current of 15 mA was supplied to the circuit for 3 minutes.

(3) Copper plating. The sample was then plated with copper using the plating bath set forth below:
25.0 g/L copper (as copper pyrophosphate)
220 g/L potassium pyrophosphate
9.7 g/L ammonium nitrate
32.3 g/L ammonium oxalate hydrate
Ammonium hydroxide to pH=8.5

The substrate and a copper anode were immersed in the plating bath at a temperature of 50° C. and a current of 20 mA was supplied to the circuit for 15 minutes, resulting in a strongly adherent copper layer with about 7.2 microns thickness.

What is claimed is:

1. A method of electroplating metal onto a transparent conductive oxide layer, the method comprising the steps of:
   a) electroplating a zinc or zinc oxide seed layer directly onto the transparent conductive oxide layer; and
   b) electroplating a strike layer on the zinc or zinc oxide seed layer; and
   c) electroplating one or more metal layers over the strike layer.

2. The method according to claim 1, wherein the transparent conductive oxide layer is selected from the group consisting of tin-doped indium oxide, aluminum-doped zinc oxide, boron-doped zinc oxide, and fluorine-doped tin oxide.

3. The method according to claim 1, wherein the step of electroplating the zinc or zinc oxide seed layer onto the transparent conductive oxide layer comprises contacting the transparent conductive oxide layer with a zinc electroplating solution comprising:
   a. a soluble zinc salt;
   b. a buffer; and
   c. a source of secondary metal ions.

4. The method according to claim 3, wherein the soluble zinc salt is selected from the group consisting of zinc sulfate, zinc methanesulfonate, zinc nitrate and zinc halides.

5. The method according to claim 3, wherein the buffer is boric acid.

6. The method according to claim 3, wherein the pH of the zinc electroplating solution is maintained at between about 5.0 and about 6.0.

7. The method according to claim 3, wherein the source of secondary metal ions comprises a source of cobalt ions or a source of nickel ions.

8. The method according to claim 3, wherein the zinc electroplating solution further comprises an additive, and wherein the additive is a polyalkylene block copolymer.

9. The method according to claim 1, wherein the strike layer comprises cobalt deposited from a cobalt strike bath.

10. The method according to claim 9, wherein the cobalt strike bath comprises a soluble cobalt salt and a complexing anion and wherein the cobalt strike bath is maintained at a pH of about 8.0.

11. The method according to claim 10, wherein the soluble cobalt salt comprises cobalt sulfate and the complexing anion comprises a citrate.

12. The method according to claim 9, further comprising the step of electroplating a metal layer onto the strike layer that comprises cobalt.

13. The method according to claim 12, wherein the metal layer is copper, and wherein the copper is electroplated from a pyrophosphate copper bath.

14. The method according to claim 13, wherein the copper layer has a thickness of at least about 4 microns.

15. The method according to claim 14, wherein the copper layer has a thickness of between about 4 and about 20 microns.

16. The method according to claim 1, wherein the transparent conductive oxide layer is disposed on a glass or silicon substrate.

17. The method according to claim 16, wherein the transparent conductive oxide layer covers at least a portion of the glass or silicon substrate.

18. A method of electroplating metal onto a transparent conductive oxide layer, the method comprising the steps of:
   a. electroplating a zinc or zinc oxide seed layer directly onto the transparent conductive oxide layer;
   b. electroplating a cobalt strike layer over the zinc or zinc oxide seed layer; and
   c. electroplating a copper layer over the cobalt strike layer.

19. The method according to claim 18, wherein the copper layer has a thickness of at least about 4 microns.

20. The method according to claim 19, wherein the copper layer has a thickness of between about 4 and about 20 microns.

* * * * *